US009342013B2

(12) United States Patent
Okajima

(10) Patent No.: US 9,342,013 B2
(45) Date of Patent: May 17, 2016

(54) FIXING DEVICE AND IMAGE FORMING APPARATUS INCLUDING SAME

(71) Applicant: KYOCERA Document Solutions Inc., Osaka (JP)

(72) Inventor: Yasuhito Okajima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/698,385

(22) Filed: Apr. 28, 2015

(65) Prior Publication Data

US 2015/0323893 A1 Nov. 12, 2015

(30) Foreign Application Priority Data

May 9, 2014 (JP) ..... 2014-097366

(51) Int. Cl.
*G03G 15/20* (2006.01)

(52) U.S. Cl.
CPC ..... *G03G 15/2085* (2013.01); *G03G 15/2053* (2013.01)

(58) Field of Classification Search
USPC ..... 399/320, 329
See application file for complete search history.

(56) References Cited

U.S. PATENT DOCUMENTS

2011/0299903 A1* 12/2011 Yamamoto ..... G03G 15/2053 399/329

FOREIGN PATENT DOCUMENTS

JP 2003-156952 A 5/2003

* cited by examiner

*Primary Examiner* — Minh Phan
(74) *Attorney, Agent, or Firm* — Stein IP, LLC

(57) ABSTRACT

According to the present disclosure, a fixing device includes a belt member and a heating device. The heating device is configured to heat the belt member. The fixing device further includes two terminal portions. The two terminal portions are electrically connected to a detector configured to detect a resistance value of the belt member, a value of a current that flows when a predetermined voltage is applied to the belt member, or a potential difference that occurs when a predetermined current is made to flow in the belt member. The two terminal portions are also contacted, on a one-to-one basis, by end-portion regions at both ends of an inner circumferential surface of the belt member in a belt-width direction of the belt member.

10 Claims, 5 Drawing Sheets

FIXING DEVICE AND IMAGE FORMING APPARATUS INCLUDING SAME

INCORPORATION BY REFERENCE

This application is based upon and claims the benefit of priority from the corresponding Japanese Patent Application No. 2014-097366 filed on May 9, 2014, of which the entire contents are incorporated herein by reference.

BACKGROUND

The present disclosure relates to a fixing device and an image forming apparatus including the same, and the present disclosure relates particularly to a fixing device configured to fix an unfixed toner image on a recording medium by inserting the recording medium through a fixing nip portion formed by a belt member and a pressure roller, and an image forming apparatus including the same.

A fixing method widely used in conventional image forming apparatuses adopting an electrophotographic method is a heat roller fixing method in which a heating roller is formed by disposing a heat source inside or outside a fixing roller, and a sheet (recording medium) carrying an unfixed toner image thereon is inserted through a fixing nip portion formed by the heating roller and a pressure roller while applying heat and pressure to the sheet, to thereby fix the toner image onto the sheet.

Besides, there has been developed a belt fixing method in which an endless-shaped fixing belt (belt member), which is heated by a heat source, is used instead of a heating roller, and a sheet carrying an unfixed toner image thereon is inserted through a fixing nip portion formed by the fixing belt and a pressure member pressed against the fixing belt, to thereby fix the toner image onto the sheet. The belt fixing method makes it possible to reduce the thermal capacity and shorten warm-up time, and to reduce power consumption, as compared with the heat roller fixing method.

Known heating methods for heating such a heating roller and a fixing belt include a lamp method in which a lamp such as a halogen lamp is used for the heating, but to meet the recent demand for shorter warm-up time and energy saving, there has been proposed an induction-heating (IH) method in which heating is provided by interlinking an alternating magnetic field with a magnetic conductor to cause an eddy current.

Here, in heating the fixing belt, a crack of the fixing belt might cause a sudden abnormal heating around the cracked portion. In particular, a heating method with a small thermal capacity tends to suffer from such a sudden abnormal heating.

To cope with this problem, there has been known a fixing device where conductive brushes contact both ends of an outer circumferential surface of a film (belt member), and a crack or the like in the film is detected by detecting a voltage difference or a current value between the two points.

SUMMARY

According to one aspect of the present disclosure, a fixing device includes a belt member formed in an endless shape, a heating device, and a pressure roller. The heating device is disposed facing an outer circumferential surface of the belt member and configured to heat the belt member. The pressure roller is pressed against the outer circumferential surface of the belt member and rotatable. The fixing device is configured to fix an unfixed toner image on a recording medium by inserting the recording medium through a fixing nip portion formed by the belt member and the pressure roller. The fixing device further includes two terminal portions. The two terminal portions are electrically connected to a detector configured to detect a resistance value of the belt member, a value of a current that flows when a predetermined voltage is applied to the belt member, or a potential difference that occurs when a predetermined current is made to flow in the belt member. The two terminal portions are contacted, on a one-to-one basis, by end-portion regions at both ends of an inner circumferential surface of the belt member in a belt-width direction of the belt member.

Still other objects and specific advantages of the present disclosure will become apparent from the following descriptions of preferred embodiments.

DETAILED DESCRIPTION

Figure 1:
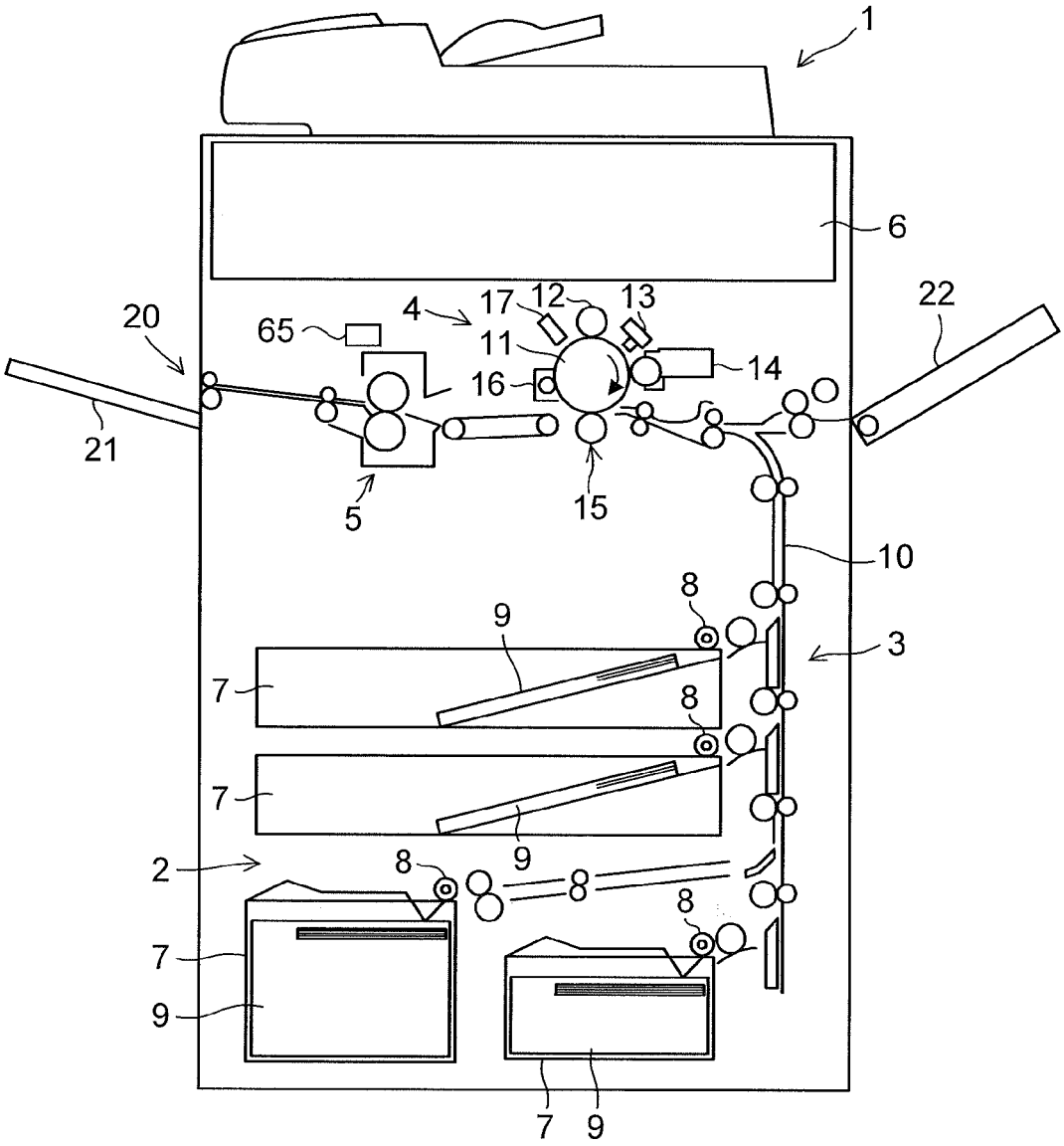
FIG. 1 is a sectional view schematically showing an overall structure of an image forming apparatus including a fixing device according to a first embodiment of the present disclosure.

Hereinafter, embodiments of the present disclosure will be described with reference to the accompanying drawings.

First Embodiment

With reference to FIG. 1 to FIG. 4, descriptions will now be given of an image forming apparatus 1 including a fixing device 5 according to a first embodiment of the present disclosure. The image forming apparatus 1 includes a sheet feeding portion 2 disposed in a lower portion of the image forming apparatus 1, a sheet conveying portion 3 disposed beside the sheet feeding portion 2, an image forming portion 4 disposed above the sheet conveying portion 3, the fixing device 5 disposed closer to an ejection side than the image forming portion 4, and an image reading portion 6 disposed above the image forming portion 4 and the fixing device 5.

The sheet feeding portion 2 includes a plurality of sheet cassettes 7 in which sheets 9 are accommodated as recording media, and a manual sheet feeding tray 22 for manual sheet feeding. When a sheet feeding roller 8 rotates, the sheets 9 are sent one by one out of a selected one of the plurality of sheet cassettes 7 to the sheet conveying portion 3. A recording medium, such as a sheet different in size from the sheets 9 accommodated in the sheet cassettes 7, an envelope, an OHP sheet, etc. is put on the manual sheet feeding tray 22, out of which the recording medium is sent to the sheet conveying portion 3.

The sheets 9 sent to the sheet conveying portion 3 are each conveyed toward the image forming portion 4 via a sheet conveying passage 10. The image forming portion 4 forms a toner image on each of the sheets 9 by means of an electrophotographic process, and the image forming portion 4 includes a photosensitive body 11 supported to be rotatable in a direction indicated by an arrow in FIG. 1, and the image forming portion 4 further includes a charging portion 12, an exposure portion 13, a developing portion 14, a transfer portion 15, a cleaning portion 16, and a diselectrifying portion 17, which are arranged in this order around the photosensitive body 11.

The charging portion 12 includes a charging roller to which a high voltage is applied, and when a predetermined potential is given to a surface of the photosensitive body 11 by the charging roller which is in contact with the surface of the photosensitive body 11, the surface of the photosensitive body 11 is uniformly charged. Then, when the photosensitive body 11 is irradiated with light from the exposure portion 13 based on image data of a document read by the image reading portion 6, the surface potential of the photosensitive body 11 is selectively attenuated, whereby an electrostatic latent image is formed on the surface of the photosensitive body 11.

Subsequently, the developing portion 14 develops the electrostatic latent image on the surface of the photosensitive body 11 to form a toner image on the surface of the photosensitive body 11. The transfer portion 15 transfers the toner image onto a sheet 9 fed between the photosensitive body 11 and the transfer portion 15.

The sheet 9, onto which the toner image has been transferred, is conveyed to the fixing device 5 disposed on a downstream side in the sheet conveying direction in the image forming portion 4. In the fixing device 5, the sheet 9 is heated and pressurized, whereby the toner image is melted and fixed on the sheet 9. Subsequently, the sheet 9, on which the toner image 9 has been fixed, is ejected onto an ejection tray 21 by an ejection roller pair 20.

After the toner image is transferred onto the sheet 9 by the transfer portion 15, residual toner remaining on the surface of the photosensitive body 11 is removed by the cleaning portion 16. In addition, residual electric charge remaining on the surface of the photosensitive body 11 is removed by the diselectrifying portion 17. Then, the photosensitive body 11 is charged again by the charging portion 12, and thereafter, image formation is performed in the same manner as just described above.

Figure 2:
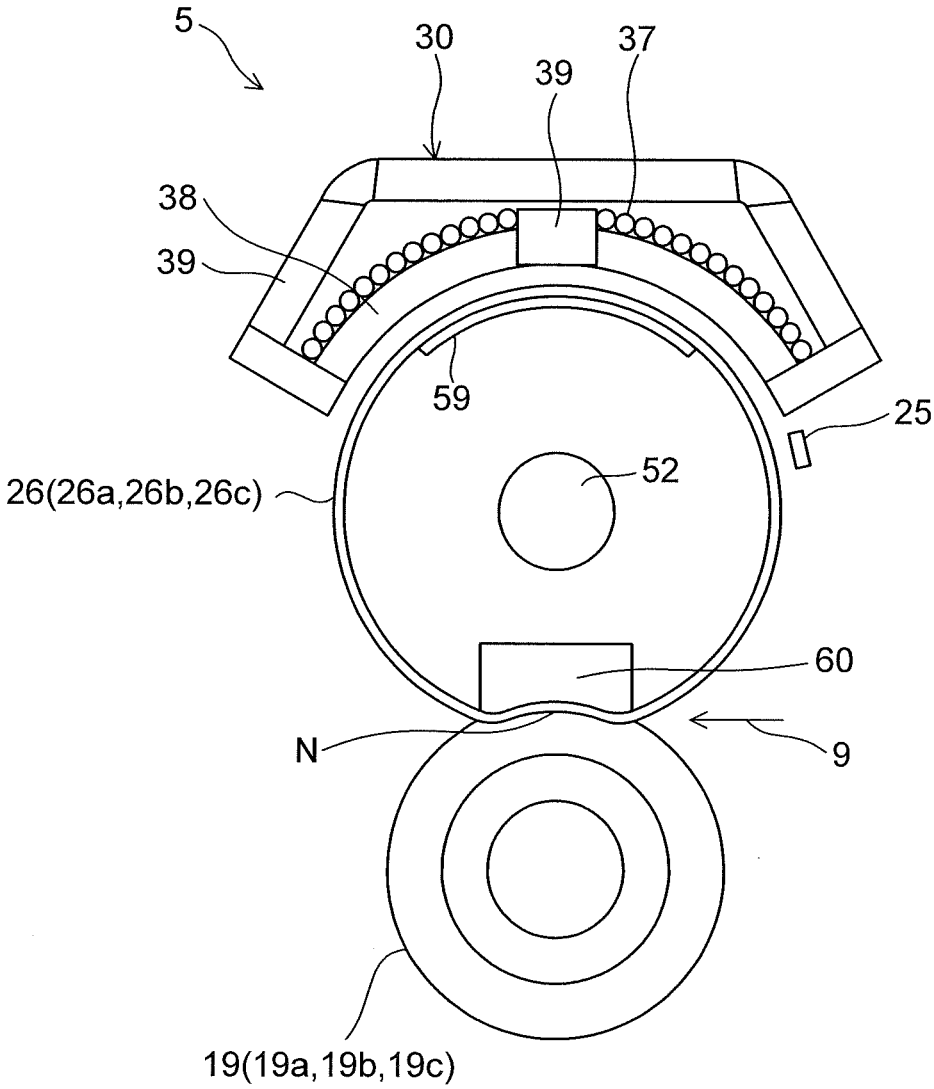
FIG. 2 is a side sectional view showing a structure of the fixing device according to the first embodiment of the present disclosure.

Next, a detailed structure of the fixing device 5 will be described. As shown in FIG. 2, the fixing device 5 employs an electromagnetic induction heating method, and includes a belt member 26, a pressure roller 19, an induction heating portion (heating device) 30 configured to heat the belt member 26, thermistors 25 as a temperature detecting portion, a belt guide member 59, and a pressing pad 60.

Figure 3:
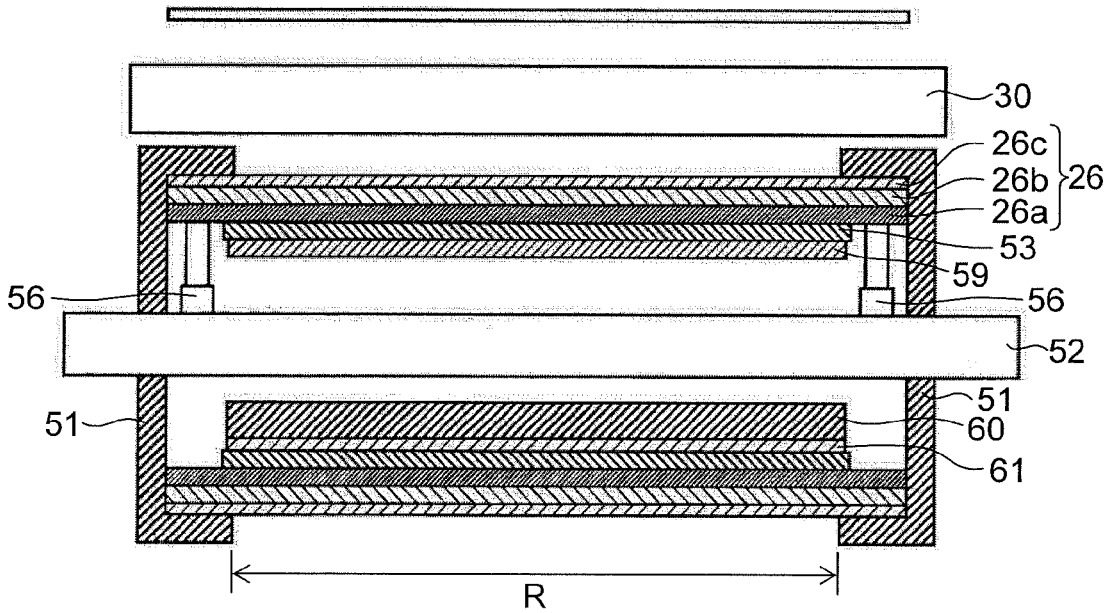
FIG. 3 is a sectional view showing a structure around a belt member of the fixing device according to the first embodiment of the present disclosure.

As shown in FIGS. 2 and 3, the belt member 26 is a heat resistant belt that is formed in an endless shape, which is formed by stacking, in order from an inner circumferential side, an induction heat generation layer 26*a* formed of, for example, electroformed nickel having a thickness of 40 μm, an elastic layer 26*b* formed of, for example, a silicone rubber, etc. having a thickness of 200 μm, and a release layer 26*c* formed of, for example, a fluororesin such as a PFA having a thickness of 30 μm provided for enhancing a release property upon melting and fixing of an unfixed toner image at a fixing nip portion N.

On each of both sides of the belt member 26 in a width direction thereof, a flange 51 is provided to reduce skew of the belt member 26. The flange 51 is attached to a shaft 52 made of SUS, SUM, etc., for example.

The belt guide member 59 is magnetic and made of magnetic SUS, etc. having a thickness of 0.8 mm, for example. As a result, the belt guide member 59 is heated by a magnetic flux that the belt member 26 has failed to absorb (that is, magnetic flux that has passed through the belt member 26). The belt guide member 59 is arc-shaped in section, and holds the belt member 26 such that the belt member 26 is at a predetermined distance from the induction heating portion 30.

As shown in FIG. 3, the belt member 26 is provided with an insulating layer 53 that is made of PTFE, etc. having a thickness of 20 μm, for example, and that is disposed at a portion where the belt guide member 59 and the belt member 26 are in contact with each other.

As shown in FIG. 2, the pressing pad 60 is held by a pad holding member (not shown), and disposed on the inner circumferential surface of the belt member 26 so as to face the pressure roller 19 via the belt member 26. Here, the belt guide member 59 and the pad holding member (not shown) may be provided integral with each other, or may be provided as separately formed members.

The pressing pad 60 presses the belt member 26 against the pressure roller 19. The pressing pad 60 is formed of a heat-resistant resin such as a liquid crystal polymer resin or an elastic material such as a silicone rubber, and an elastomer may be disposed on a sliding surface that faces the belt member 26. On the sliding surface, there is provided a sliding sheet 61 (see FIG. 3) made of a fluororesin material such as a PTFE sheet, for the purpose of reducing sliding load on a contact surface with the belt member 26.

The pressure roller 19 includes a cylindrical core metal bar 19*a* made of stainless steel, etc., an elastic layer 19*b* formed on the core metal bar 19*a* and formed of a silicone rubber, for example, and a release layer 19*c* formed of a fluororesin, etc. so as to cover a surface of the elastic layer 19*b*. The pressure roller 19 is configured to be driven to rotate by an unillustrated drive source such as a motor, and the belt member 26 is configured to be caused to perform driven-rotation by the rotation of the pressure roller 19. The fixing nip portion N is formed at a portion where the pressure roller 19 and the belt member 26 are pressed against each other, and at the fixing nip portion N, heat and pressure is applied to a sheet 9 having an unfixed toner image formed thereon and conveyed to the fixing nip portion N, and thereby the toner image is fixed on the sheet 9.

The induction heating portion 30 includes an exciting coil 37, a bobbin 38, and a magnetic core 39, and is configured to heat the belt member 26 by means of electromagnetic induction. The induction heating portion 30 is disposed facing the fixing belt 26 such that it extends in a width direction of the belt member 26 (a direction perpendicular to the surface of the sheet on which FIG. 2 is drawn) so as to surround substantially one half of an outer circumference of the belt member 26.

The exciting coil 37 is formed of a litz wire that is looped a plurality of times in the width direction of the belt member 26 (the direction perpendicular to the surface of the sheet on which FIG. 2 is drawn), and the exciting coil 37 is attached to the bobbin 38. The exciting coil 37 is connected to an unillustrated power supply, and generates an AC magnetic flux using a high-frequency current supplied from the power supply. The magnetic flux from the exciting coil 37 passes through the magnetic core 39 to be directed in a direction parallel to the surface of the sheet on which FIG. 2 is drawn, and the magnetic flux passes along the induction heat generation layer 26*a* of the fixing belt 26. AC-like variations in strength of the magnetic flux passing through the induction heat generation layer 26*a* create an eddy current in the induction heat generation layer 26*a*. When the eddy current flows in the induction heat generation layer 26*a*, Joule heat is generated by the electric resistance of the induction heat generation layer 26*a*, and thus the belt member 26 generates heat.

The thermistors 25 are disposed so as to face a surface of the belt member 26 at a center and both ends of the belt member 26 in its width direction, and the thermistors 25 detect temperatures of respective regions. The current supplied to the exciting coil 37 of the induction heating portion 30 is controlled based on the temperatures detected by the thermistors 25.

When the belt member 26 is heated by the induction heating portion 30, which is heating means, to a temperature at which fixing is possible, a sheet 9 held in the fixing nip N is heated and also pressurized by the pressure roller 19, whereby toner in a powder state on the sheet 9 is melted and fixed. Thus, since the belt member 26 is made of a thin material with satisfactory thermal conductivity and its thermal capacity is low, the fixing device 5 can be warmed up in a short period of time, and this contributes to quick start of an image forming operation. After going through the fixing process, the sheet 9 is conveyed by adhering to the surface of the belt member 26 and then separated from the surface of the belt member 26 by an unillustrated separation member, and conveyed downstream of the fixing device 5.

Figure 4:
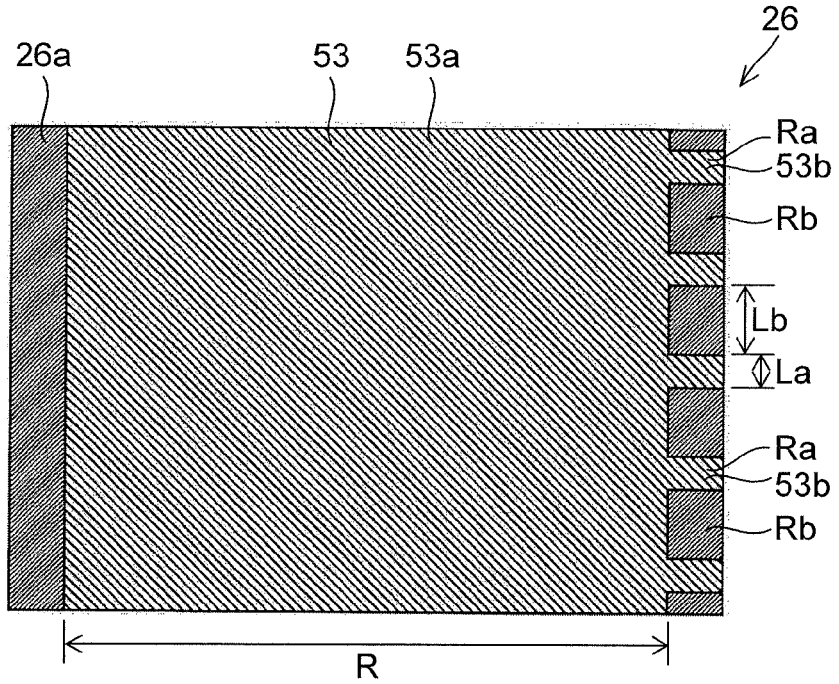
FIG. 4 is a diagram showing a shape of an insulating layer of an inner circumferential surface of the belt member of the fixing device according to the first embodiment of the present disclosure.

As shown in FIG. 4, in the present embodiment, the insulating layer 53 is provided at the inner circumferential surface of the belt member 26, and has an inner region (first insulating layer) 53*a* disposed at a sheet-passing region (recording-medium passing region) R, and a plurality of outer regions (second insulating layers) 53*b* disposed outside the sheet-passing region R. In FIG. 4, for ease of understanding, hatching is applied to the insulating layer 53 and the induction heat generation layer 26*a*. In FIG. 4, the inner region 53*a* of the insulating layer 53 coincides with the sheet-passing region R, but the inner region 53*a* may instead be somewhat larger or smaller than the sheet-passing region R.

The outer regions 53*b* are formed in plurality at one (here, right end-portion region) of end-portion regions at the both ends of the inner circumferential surface of the belt member 26 in its belt width direction (right-left direction in FIG. 4), at predetermined pitches in a circumferential direction of the belt member 26. Thereby, at the one of the end-portion regions of the inner circumferential surface of the belt member 26, there are formed a plurality of insulating regions Ra where the insulating layer 53 is provided, and a plurality of conductive regions Rb where the insulating layer 53 is not provided. At such areas in the end-portion regions as are not provided with the insulating layer 53, the induction heat generation layer 26*a* is exposed to the inner circumferential surface side of the belt member 26.

The plurality of insulating regions Ra are formed in rectangular shapes having a same length La in the circumferential direction, and the plurality of insulating regions Ra are arranged at predetermined pitches in the circumferential direction of the belt member 26. The plurality of conductive regions Rb are formed in rectangular shapes having a same length Lb in the circumferential direction, and the plurality of conductive regions Rb are arranged at predetermined pitches in the circumferential direction of the belt member 26. Here, the length La of the insulating regions Ra in the circumferential direction is smaller than the length Lb of the conductive regions Rb in the circumferential direction. Also, in the present embodiment, the insulating regions Ra are each formed to extend parallel to an axial direction of the shaft 52 (axial direction of the pressure roller 19, belt-width direction).

As shown in FIG. 3, the end-portion regions at the both ends of the inner circumferential surface of the belt member 26 (non-passing regions outside the sheet-passing region R) are contacted with terminal portions 56 on a one-to-one basis. The terminal portions 56 are held by the shaft 52 and an unillustrated holding member, etc. The terminal portions 56 are formed using a conductive brush, a conductive plate spring, or a conductive sheet (for example, a conductive polyimide sheet).

A detector 65 (see FIG. 1) configured to detect resistance values is electrically connected to the terminal portions 56 via unillustrated wiring. Thereby, it is possible to detect a resistance value of the belt member 26 between the terminal portions 56. A result of detection by the detector 65 equal to or greater than a predetermined value indicates a high possibility of existence of a crack in the belt member 26, and thus power supply to the induction heating portion 30 is stopped.

The detector 65 is constituted by a resistance-value measuring device configured to detect a resistance value between the two terminal portions 56, but the detector 65 may be a device configured to detect a value of a current that flows when a predetermined voltage is applied across the two terminal portions 56, or may be a device configured to detect a potential difference that occurs when a predetermined current is made to flow between the two terminals 56. Note that it is possible to detect a crack in the belt member 26 by detecting current values or potential differences by using these devices. In a case where a device configured to detect current values is used as the detector 65, a measurement result equal to or smaller than a predetermined value indicates a high possibility of existence of a crack in the belt member 26. In a case where a device configured to detect a potential difference is used as the detector 65, a measurement result equal to or greater than a predetermined value indicates a high possibility of existence of a crack in the belt member 26.

As for timing of performing crack detection described above, crack detection may be performed each time printing has been performed on a predetermined number of sheets, or may be performed each time printing has been performed for a predetermined period of time.

In the present embodiment, as described above, the two terminal portions 56 electrically connected to the detector 65 are contacted with the end-portion regions at the both ends of the inner circumferential surface of the belt member 26 on the one-to-one basis. Thereby, it is possible to detect a resistance value of the belt member 26, a value of a current that flows when the predetermined voltage is applied to the belt member 26, or a potential difference that occurs when the predetermined current is made to flow in the belt member 26, and thus to detect a crack in the belt member 26.

By contacting the terminal portions 56 with the inner circumferential surface of the belt member 26, unlike in a case where the terminal portions 56 are contacted with an outer circumferential surface of the belt member 26, the terminal portions 56 can be disposed inside the belt member 26, and thus it is possible to reduce increase in size of the fixing device 5.

Furthermore, by contacting the terminal portions 56 with the inner circumferential surface of the belt member 26, tension is applied to the belt member 26, and this helps reduce escape (departing) of the belt member 26 from the terminal portions 56, allowing the terminal portions 56 and the belt member 26 to contact each other stably.

As described above, the induction heat generation layer 26*a* of the belt member 26 is exposed to the inner circumferential surface side of the belt member 26 and is also contacted by the terminal portions 56. Thereby, a crack in the belt member 26 can be detected easily, without providing the belt member 26 with an additional conductive layer or the like for crack detection to the belt member 26.

As described above, with the arrangement where the belt member 26 and the magnetic belt guide member 59 are provided, if a crack occurs in the belt member 26, a magnetic flux passes through the cracked portion. As a result, the belt guide member 59 directly absorbs the magnetic flux, and this causes the temperature of the belt guide member 59 to rises sharply to a high temperature. Thus, with the above arrangement, it is particularly advantageous to detect a crack in the belt member 26 and stop power supply to the induction heating portion 30.

As described above, the inner region 53*a* (insulating layer 53) is provided at the portion where the belt guide member 59 and the belt member 26 contact each other. Thereby, the belt guide member 59 and the belt member 26 are not electrically connected to each other, and thus it is possible to reduce missing of crack detection in the belt member 26.

As described above, the outer regions 53*b* (insulating layer 53) are provided at the one of the end-portion regions at the both ends of the inner circumferential surface of the belt member 26 at the predetermined pitches. Thereby, it is possible to detect a rotation rate of the belt member 26 from a variation cycle of the resistance value of the belt member 26, etc. That is, it is possible to detect existence/absence of rotation, slipping, etc. of the belt member 26.

As described above, the outer regions 53*b* are provided only at one of the end-portion regions at both ends of the inner circumferential surface of the belt member 26. Thereby, variations in resistance value, etc. of the belt member 26 can be detected with high accuracy.

As described above, the terminal portions 56 are formed by using a conductive brush, a conductive plate spring, or a conductive sheet. Thereby, it is possible to detect a resistance value of the belt member 26, etc. with a simple configuration, while reducing damaging of the inner circumferential surface of the belt member 26.

With the above arrangement, it is possible to detect resistance values, etc. between the two terminal portions 56. Thus, as described above, by contacting the terminal portions 56 with the non-passing regions outside the sheet-passing region R of the inner circumferential surface of the belt member 26, it is possible to easily detect a crack occurring in the sheet-passing region R of the belt member 26.

Second Embodiment

Next, with reference to FIG. 5 and FIG. 6, a description will be given of a fixing device 5 according to a second embodiment of the present disclosure.

Figure 5:
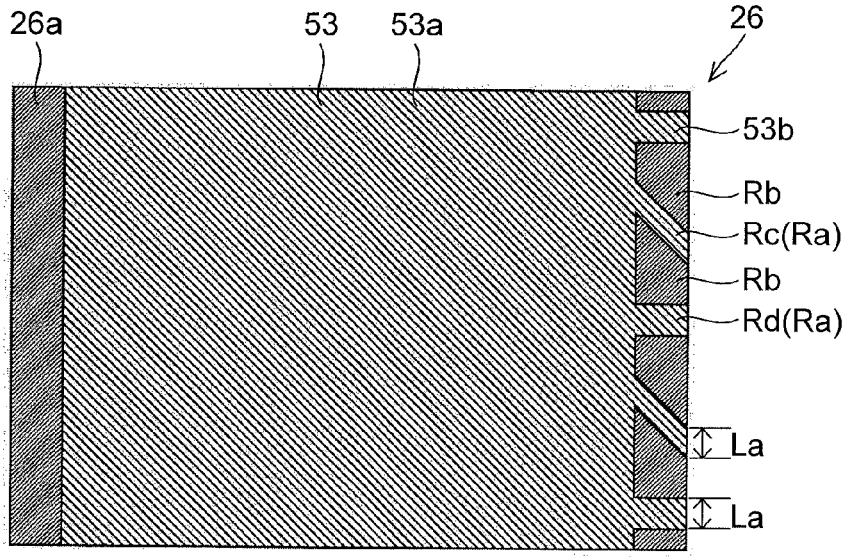
FIG. 5 is a diagram showing a shape of an insulating layer of an inner circumferential surface of a belt member of a fixing device according to a second embodiment of the present disclosure.

In the second embodiment of the present disclosure, as shown in FIG. 5, the outer regions 53*b* include first regions Rc extending in a first direction inclined with respect to the axial direction of the shaft 52 (right-left direction in FIG. 5), and second regions Rd extending in a direction crossing the first direction. The second regions Rd are formed, for example, so as to extend parallel to the axial direction of the shaft 52 as shown in FIG. 5. The first regions Rc and the second regions Rd are alternately arranged at predetermined pitches in the circumferential direction of the belt member 26.

Lengths of the first and second regions Rc and Rd in the circumferential direction are constant along the axial direction of the shaft 52, and denoted by "La". On the other hand, the conductive regions Rb are formed trapezoidal, and lengths of the conductive regions Rb in the circumferential direction increase or decrease along the axial direction of the shaft 52. Thereby, when the belt member 26 moves in the axial direction of the shaft 52 (that is, when the belt member 26 skews), timing or time when the terminal portion 56 passes over the conductive regions Rb changes, and the skew of the belt member 26 can be detected.

Figure 6:
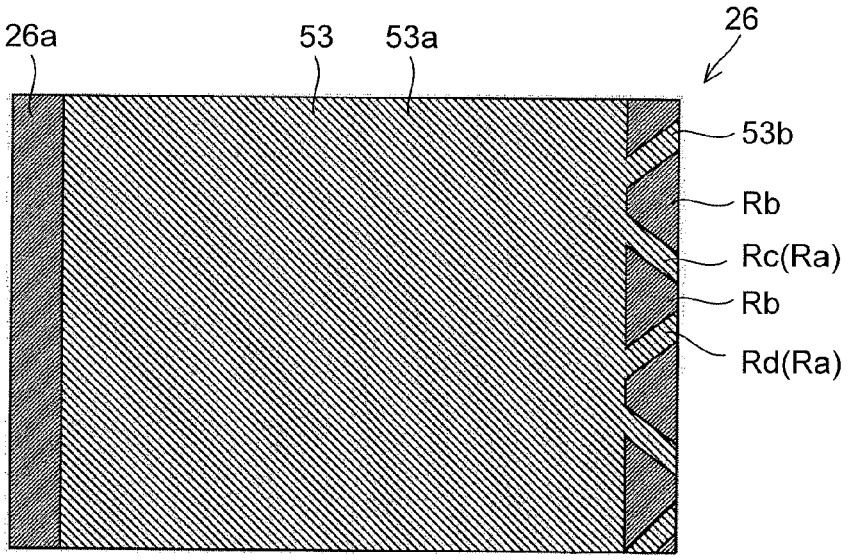
FIG. 6 is a diagram showing another example of the shape of the insulating layer of the inner circumferential surface of the belt member of the fixing device according to the second embodiment of the present disclosure.

Here, as shown in FIG. 6, the second regions Rd may also be formed to extend in a direction inclined with respect to the axial direction of the shaft 52. In this case, it is desirable that the second regions Rd be inclined in a direction opposite to the direction in which the first regions Rc are inclined with respect to the axial direction of the shaft 52.

Other structures of the second embodiment are similar to those of the first embodiment described above.

In the present embodiment, as described above, the outer regions 53*b* include the first regions Rc extending in the first direction inclined with respect to the axial direction of the pressure roller 19, and the second regions Rd extending in the second direction crossing the first direction. Thereby, when the belt member 26 moves in the axial direction of the shaft 52, the timing or time when the terminal portion 56 passes over the conductive regions Rb changes, and thereby the skew of the belt member 26 can be detected.

As described above, in the case where the second regions Rd are inclined in a direction opposite, with respect to the axial direction of the shaft 52, to the direction in which the first regions Rc are inclined, the timing or time when the terminal portion 56 passes over the conductive regions Rb changes further greatly when the belt member 26 moves in the axial direction of the shaft 52, and this makes it possible to detect the skew of the belt member 26 with higher accuracy.

Other advantages of the second embodiment are similar to those of the first embodiment described above.

Third Embodiment

Next, with reference to FIG. 7 and FIG. 8, a description will be given of a fixing device 5 according to a third embodiment of the present disclosure.

Figure 7:
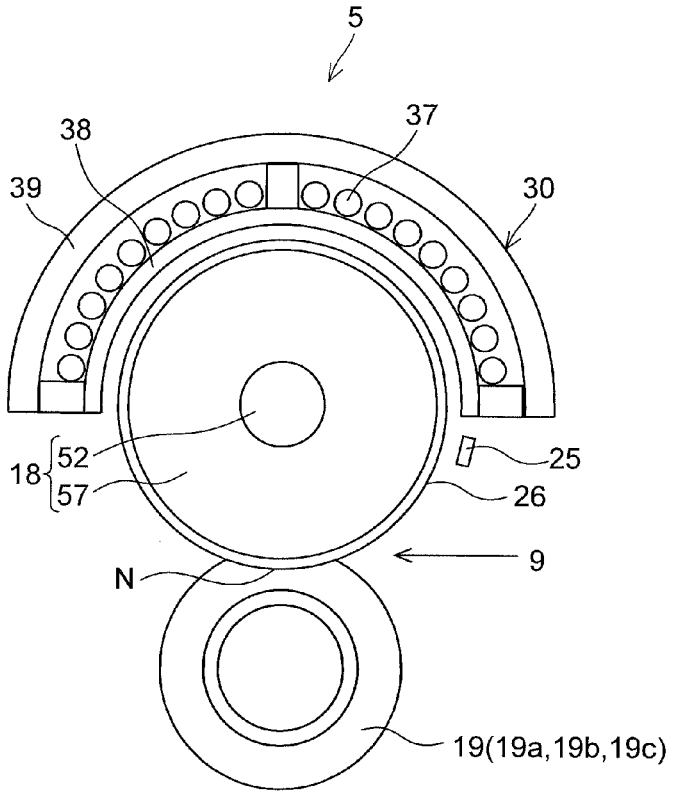
FIG. 7 is a side sectional view showing a structure of a fixing device according to a third embodiment of the present disclosure.
Figure 8:
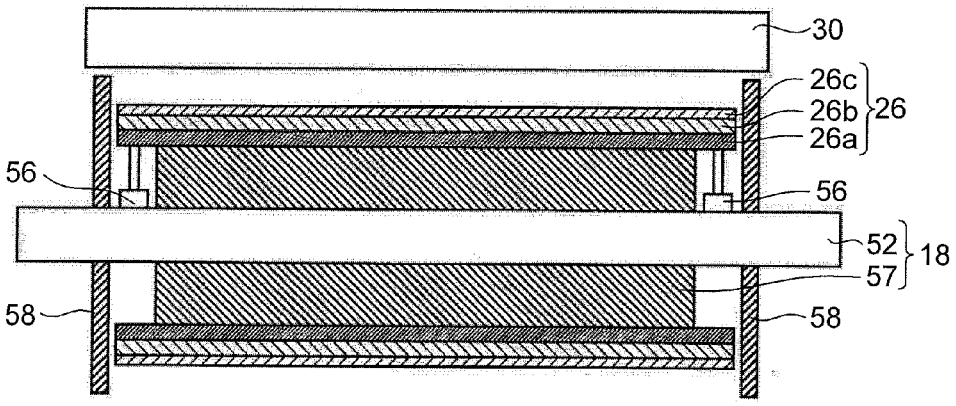
FIG. 8 is a sectional view showing a structure around a belt member of the fixing device of the third embodiment of the present disclosure.

In the third embodiment of the present disclosure, as shown in FIG. 7, the fixing device 5 includes a belt member 26, a fixing roller 18 disposed on an inner circumferential surface of the belt member 26, a pressure roller 19, an induction heating portion 30, and thermistors 25.

The fixing roller 18 stretches the inner circumferential surface of the belt member 26 to make the belt member 26 integrally rotatable. For example, the fixing roller 18 has an elastic layer 57 formed of silicone sponge having a thickness of 20 mm and disposed on the shaft 52, and the elastic layer 57 stretches the belt member 26.

Since the elastic layer 57 is insulating, there is no need of providing an insulating layer at a portion where the elastic layer 57 and the belt member 26 contact each other. That is, the inner region 53*a* of the insulating layer 53 does not need to be provided.

Here, a pulley 58 made of a PPS resin, etc. is provided on each side of the belt member 26 in its width direction, and thereby, skew of the belt member 26 can be reduced.

Other structures and advantages of the third embodiment are similar to those of the first and second embodiments described above.

It should be understood that the embodiments disclosed herein are merely illustrative in all respects, and should not be interpreted restrictively. The range of the present disclosure is shown not by the above descriptions of the embodiments but by the scope of claims for patent, and it is intended that all modifications within the meaning and range equivalent to the scope of claims for patent are included.

For example, in the examples hereinabove, the present disclosure is applied to monochrome image forming apparatuses, but this is not meant as a limitation, and needless to say, the present disclosure is applicable also to color image forming apparatuses.

In addition, the above embodiments have dealt with examples where the induction heating portion 30 is used as a heating device, but this is not meant as a limitation, and a heater constituted by a halogen lamp, etc. may be used as a heating device.

The above-described first embodiment has dealt with an example where the insulating layer 53 is provided with the inner region 53*a* and the outer regions 53*b*, but this is not meant as a limitation. The inner region 53*a* and the outer regions 53*b* are provided as necessary, and thus, only either the inner region 53*a* or the outer regions 53*b* may be provided.

In a case where the outer regions 53*b* are not provided, an inner region (first insulating layer) may be provided at an outer circumferential surface of the belt guide member 59.

The above-described embodiments have dealt with examples where the belt member 26 is provided with the induction heat generation layer 26*a*, and the terminal portions 56 are contacted with the induction heat generation layer 26*a*, but this is not meant as a limitation. The belt member 26 may be provided with a conductive layer, etc. other than the induction heat generation layer 26*a*, and the terminal portions 56 may be contacted with the layer, to thereby detect a crack in the belt member 26.

The second embodiment discussed above has dealt with a case where the present disclosure is applied to a single-shaft fixing device 5 where the belt member 26 is stretched on the fixing roller 18, but this is not meant as a limitation, and the present disclosure may be applied to a multi-shaft (two-shaft) fixing device where the belt member 26 is stretched by the fixing roller 18 and a heating roller, etc.

It should be understood that configurations obtained by appropriately combining the configurations of the foregoing embodiments and modified examples are also included in the scope of the present disclosure.

What is claimed is:

1. A fixing device, comprising:

a belt member formed in an endless shape;

a heating device disposed facing an outer circumferential surface of the belt member and configured to heat the belt member; and a pressure roller pressed against the outer circumferential surface of the belt member and rotatable, the fixing device being configured to fix an unfixed toner image formed on a recording medium by inserting the recording medium through a fixing nip portion formed by the belt member and the pressure roller, wherein the fixing device further comprises two terminal portions that are electrically connected to a detector configured to detect a resistance value of the belt member, a value of a current that flows when a predetermined voltage is applied to the belt member, or a potential difference that occurs when a predetermined current is made to flow in the belt member; and the two terminal portions are contacted, on a one-to-one basis, by end-portion regions at both ends of an inner circumferential surface of the belt member in a belt-width direction.

2. The fixing device according to claim 1, wherein the belt member has an induction heat generation layer configured to be heated by the heating device by means of electromagnetic induction heating; and the induction heat generation layer is exposed to an inner-circumferential-surface side of the belt member and contacted by the terminal portions.

3. The fixing device according to claim 2, further comprising a belt guide member that is magnetic, that is disposed facing the heating device with the belt member interposed between the belt guide member and the heating device, and that contacts the inner circumferential surface of the belt member and guides the belt member.

4. The fixing device according to claim 3, wherein a first insulating layer is provided at a portion where the belt guide member and the belt member contact with each other.

5. The fixing device according to claim 1, wherein at least one of the end-portion regions at the both ends of the inner circumferential surface of the belt member is provided with second insulating layers having a same length in a circumferential direction of the belt member and disposed at predetermined pitches in the circumferential direction of the belt member.

6. The fixing device according to claim 5, wherein the second insulating layers include:

first regions extending in a first direction inclined with respect to an axial direction of the pressure roller; and second regions extending in a second direction crossing the first direction; and the first regions and the second regions are alternately arranged in the circumferential direction of the belt member.

7. The fixing device according to claim 5, wherein the second insulating layers are provided only at one of the end-portion regions at the both ends of the inner circumferential surface of the belt member.

8. The fixing device according to claim 1, wherein the terminal portions are formed by using a conductive brush, a conductive plate spring, or a conductive sheet.

9. The fixing device according to claim 1, wherein the terminal portions are contacted by non-passing regions of the inner circumferential surface of the belt member, the non-passing regions being located outside a recording-medium passing region of the inner circumferential surface of the belt member.

10. An image forming apparatus, comprising:

the fixing device according to claim 1; and the detector.

* * * * *